US009821898B1

(12) United States Patent
Whatcott

(10) Patent No.: US 9,821,898 B1
(45) Date of Patent: Nov. 21, 2017

(54) PEDAL-POWERED WATER PROPULSION DEVICE

(71) Applicant: Weston Whatcott, Payson, UT (US)

(72) Inventor: Weston Whatcott, Payson, UT (US)

( * ) Notice: Subject to any disclaimer, the term of this patent is extended or adjusted under 35 U.S.C. 154(b) by 0 days.

(21) Appl. No.: 15/231,175

(22) Filed: Aug. 8, 2016

Related U.S. Application Data

(60) Provisional application No. 62/212,905, filed on Sep. 1, 2015.

(51) Int. Cl.

| | |
|---|---|
| ***B63H 16/20*** | (2006.01) |
| ***A63B 35/08*** | (2006.01) |
| ***B63B 29/04*** | (2006.01) |
| ***B63H 1/14*** | (2006.01) |

(52) U.S. Cl.
CPC ..... *B63H 16/20* (2013.01); *B63B 29/04* (2013.01); *B63H 1/14* (2013.01); *B63B 2029/043* (2013.01); *B63H 2016/202* (2013.01)

(58) Field of Classification Search
CPC ... B63B 29/04; B63B 2029/043; B63B 35/74; B63H 1/14; B63H 16/08; B63H 2016/085; B63H 16/14; B63H 16/20; B63H 2016/202; B63H 2016/205; B63H 2016/207; A63B 35/08; A63B 35/10
USPC ..... 440/21, 26–31
See application file for complete search history.

(56) References Cited

U.S. PATENT DOCUMENTS

| | | | | | |
|---|---|---|---|---|---|
| 732,405 | A * | 6/1903 | Gallagher | B63H 16/14 | 440/31 |
| 1,457,908 | A * | 6/1923 | Kupsche | A63B 35/10 | 440/31 |
| 1,578,395 | A * | 3/1926 | Chapin | B63H 16/14 | 440/31 |
| 1,650,497 | A * | 11/1927 | Dayde | A63B 35/10 | 440/31 |
| 1,687,194 | A * | 10/1928 | Caldwell | A63B 35/10 | 114/283 |
| 1,752,051 | A * | 3/1930 | Young | A63B 35/10 | 440/31 |
| 2,317,905 | A | 4/1943 | Galkin | | |
| 2,368,569 | A * | 1/1945 | Reeves | A63B 35/10 | 440/31 |
| 2,420,422 | A * | 5/1947 | Gilliam | A63B 35/10 | 440/31 |
| 5,362,264 | A | 11/1994 | Parant | | |
| 5,509,831 | A | 4/1996 | Gelbart | | |
| 5,672,080 | A | 9/1997 | Gauthier | | |
| 6,077,134 | A | 6/2000 | Lam | | |
| 6,231,408 | B1 | 5/2001 | Lekhtman | | |

(Continued)

FOREIGN PATENT DOCUMENTS

| | | | | |
|---|---|---|---|---|
| BR | WO 2016134429 A1 * | 9/2016 | | B63B 7/00 |
| CN | EP 1972544 A2 * | 9/2008 | | B63H 16/14 |

(Continued)

*Primary Examiner* — Ajay Vasudeva
(74) *Attorney, Agent, or Firm* — Robert C. Montgomery; Montgomery Patent & Design LP.

(57) ABSTRACT

A peddle-actuated water propulsion device includes a seat with lower body harness, a support tube, a pair of crank-type pedals, and a propeller within a protective screen guard. The pedals are in mechanical communication with the propeller. The propeller is configured to accept a plurality of differently sized blades and may be positioned at a user-selected angle.

15 Claims, 3 Drawing Sheets

(56) References Cited

U.S. PATENT DOCUMENTS

| | | | |
|---|---|---|---|
| 8,342,897 | B2 | 1/2013 | Gater et al. |
| 2011/0275487 | A1 | 11/2011 | Richards et al. |

FOREIGN PATENT DOCUMENTS

| | | | | | |
|---|---|---|---|---|---|
| FR | 1005643 | A | * | 4/1952 | ..... B63H 16/14 |
| KR | WO 2004091736 | A1 | * | 10/2004 | ..... A63B 35/10 |

* cited by examiner

PEDAL-POWERED WATER PROPULSION DEVICE

RELATED APPLICATIONS

This application is a continuation of and claims the benefit of U.S. Provisional Application No. 62/212,905, which was filed Sep. 1, 2015, the entire disclosures of which are incorporated herein by reference.

FIELD OF THE INVENTION

The presently disclosed subject matter is directed to devices for propelling people through water. More particularly, the present invention relates to pedal-actuated water propulsion devices.

BACKGROUND OF THE INVENTION

Skis, jet skis, surfboards, boogie boards, and the like are all great for fun in the water. They provide countless hours of entertainment and become even more enjoyable as the user becomes more skilled. However, the cost to buy and operate such products is quite high and accidents are not uncommon. Other devices such as surfboards only work at certain times on certain bodies of water which not everyone has access to. Additionally, not everyone has the skills to operate some specialized watercraft such as canoes.

Accordingly, there exists a need for a water-based recreational craft that can be made available at relatively low cost, is inexpensive to operate, can be used by almost all people, and is suitable for almost all bodies of water. Such a water-based recreation craft could provide unique water recreation in a manner that is simple, easy, and effective.

SUMMARY OF THE INVENTION

The principles of the present invention provide for a water-based recreational craft that can be made available at relatively low cost, is inexpensive to operate, can be used by almost all people, and is suitable for almost all bodies of water. Such a water-based recreation craft provides unique water recreation in a manner that is simple, easy, and effective.

A pedal-powered water propulsion vehicle that is in accord with the present invention includes a seat assembly having a seat that is attached to an adjustable seat frame, an enclosed crank housing that is attached to the seat frame, and drive system within the crank housing. The drive system includes a first driven gear that is coupled to a second driven gear. Also included is a pedal-operated crank for applying rotational force to the first driven gear and to the second driven gear, a drive shaft assembly having a first drive shaft that is turned by the second driven gear, and a propeller that is turned by the drive shaft assembly. The propeller is capable of moving a user on the seat through water.

In practice the seat frame may include an outer support tube that is attached to the seat and an inner support tube that is engaged within the outer support tube and that is attached to the crank housing. The outer support tube can be made selectively vertically adjustable relative to the inner support tube. A locking mechanism may be included for locking the outer support tube relative to the inner support tube.

In practice there will be a first pedal and a second pedal that are attached to the crank. The drive shaft assembly may further include a second drive shaft having a first end that is mechanically coupled to the first drive shaft using an angularly adjustable universal joint. That first drive shaft is beneficially located within a first drive shaft housing that extends from the crank housing. The first drive shaft housing may extend from the crank housing at a first adjustable angle, which may be locked. The second drive shaft is preferably located within a second drive shaft housing that extends from the first drive shaft housing at a second adjustable angle, which may also be locked.

A propeller guard may be attached to the second drive shaft housing, preferably such that the propeller guard encompasses the propeller. The first driven gear can a bevel gear and the second driven gear can also be a bevel gear. The seat assembly might also include a pelvic harness and a pair of waist straps having a buckle.

A water propulsion vehicle that is in accord with the present invention includes a seat assembly having a seat that is attached to a seat frame, an enclosed crank housing that is attached to the seat frame, a first bevel gear within the crank housing that drives a second bevel gear within the crank housing, and a crank for applying rotational force to the first bevel gear to drive the second bevel gear. Also included is a first pedal and a second pedal that are attached to the crank, a first drive shaft turned by the second bevel gear, a second drive shaft turned by the first drive shaft; and a propeller turned by the second drive shaft. The propeller is capable of moving a user on the seat through water.

That seat frame includes an outer support tube attached to the seat and having outer support tube apertures, an inner support tube slidingly received within the outer support tube, the inner support tube having inner support tube apertures, and a spring-loaded button attached to the inner support tube for locking the inner support tube relative to the outer support tube such that the height of the seat with respect to the crank can be adjusted.

The first pedal may include a hydrodynamic-shaped toe clip and a heel strap. The first drive shaft tube can be used to enclose the first drive shaft. That first drive shaft tube then may be angularly affixed to the crank housing via an adjusting bracket. The first drive shaft and the second drive shaft can be coupled together using a universal joint.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
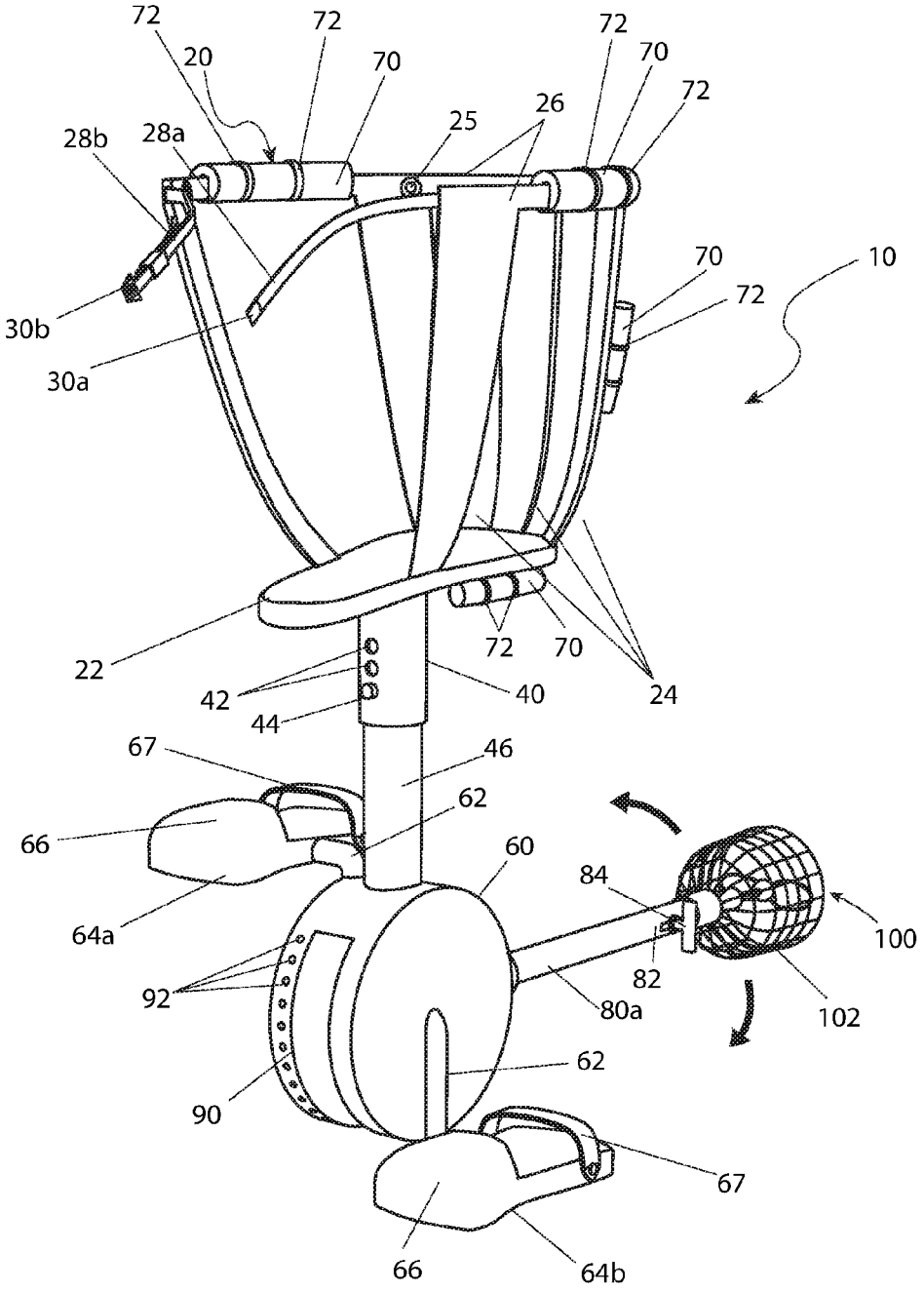
FIG. 1 is a side perspective view of a pedal-actuated water propulsion device 10 that is in accord with a preferred embodiment of the present invention.

10 pedal-powered water propulsion device
20 seat assembly
22 seat
24 pelvic harness
25 fastener
26 upper frame member
**28*a*** first waist strap

28*b* second waist strap
30*a* first buckle
30*b* second buckle
40 outer support tube
42 seat adjustment aperture
44 spring button
46 inner support tube
60 enclosed protective crank housing
62 crank
64*a* first foot pedal
64*b* second foot pedal
66 toe clip
67 heel strap
68*a* first bevel gear
68*b* second bevel gear
80*a* first drive shaft tube
80*b* second drive shaft tube
81*a* first drive shaft
81*b* second drive shaft
82 tightening device
83 axle
84 knob
86 universal joint
90 housing slot
92 housing aperture
94 adjusting bracket
96 lock bolt
100 propeller
102 propeller guard

DETAILED DESCRIPTION OF THE PREFERRED EMBODIMENT

Figure 2:
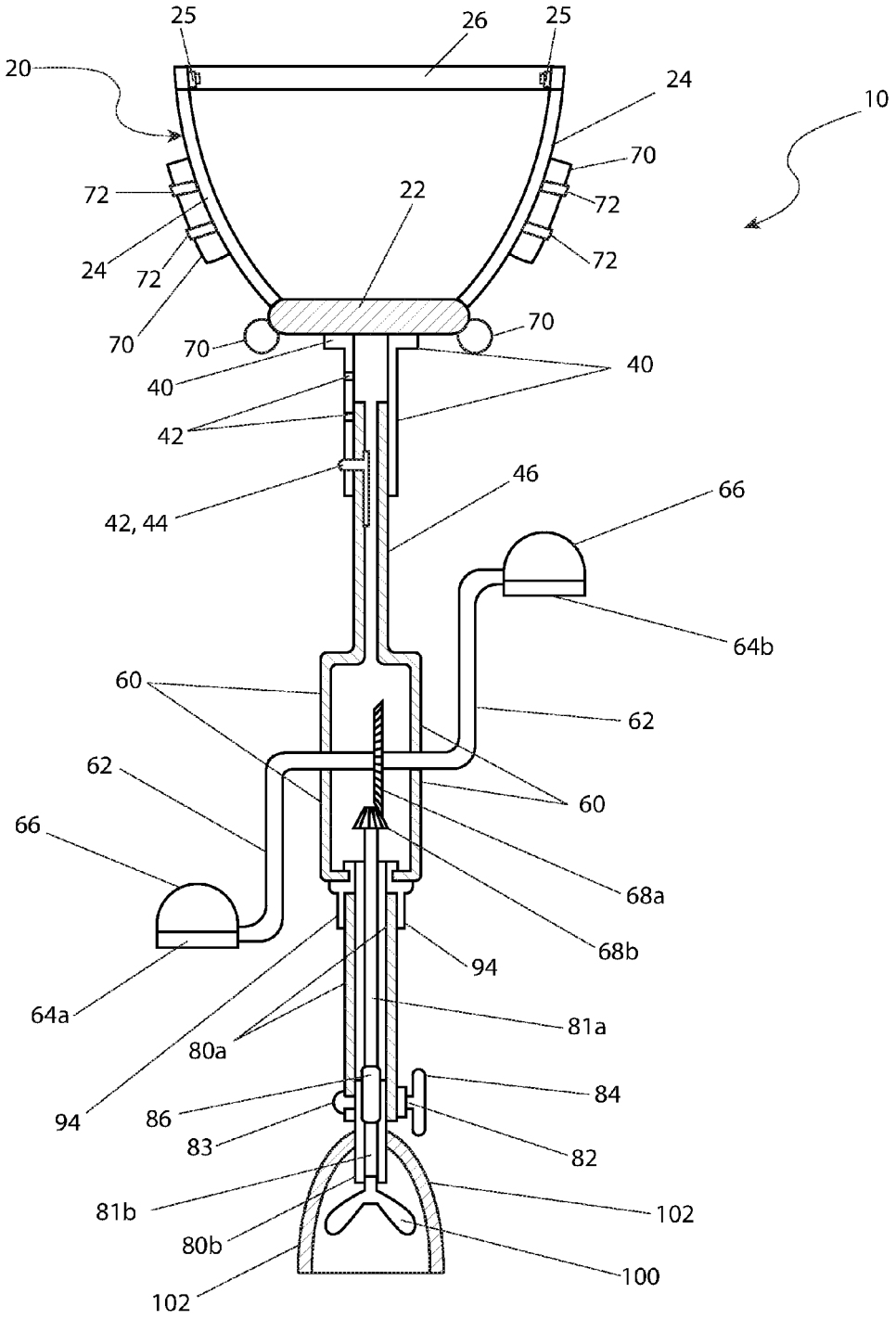
FIG. 2 is a sectional view of the pedal-actuated water propulsion device 10 of FIG. 1 taken along section line A-A of FIG. 3; and, FIG. 3 is another perspective view of the pedal-actuated water propulsion device 10 of FIG. 1 but depicting various positions of the propeller 100.
Figure 3:
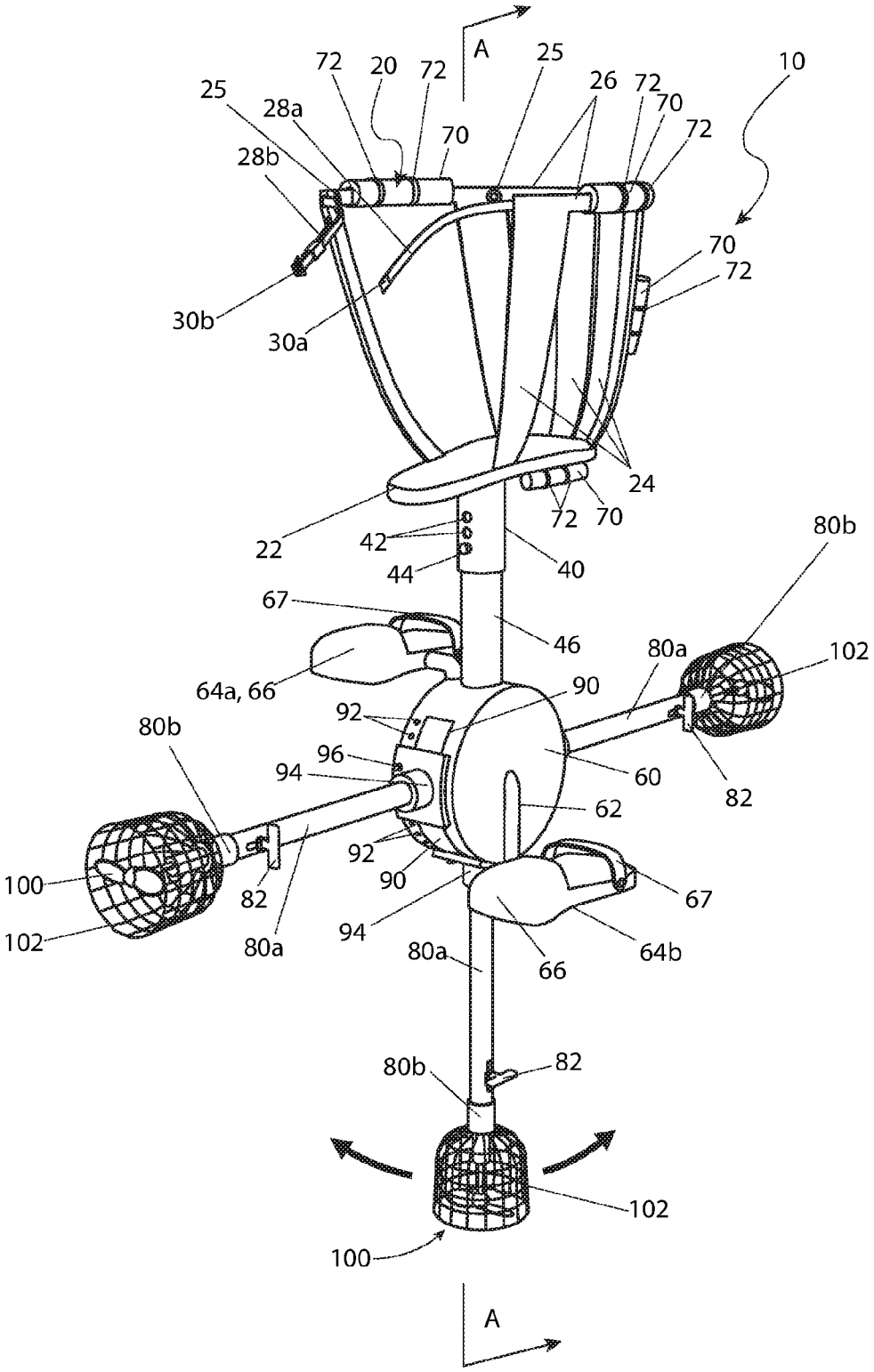

The preferred embodiment of the present invention is depicted in FIGS. 1-3. However, the invention is not limited to the specifically described and illustrated embodiment. A person skilled in the art will appreciate that many other embodiments of the invention are possible without deviating from the basic concept of the invention and that any such work around will also fall under the scope of this invention.

In the figures like numbers refer to like elements throughout. Additionally, the terms "a" and "an" as used herein do not denote a limitation of quantity, but rather denote the presence of at least one (1) of the referenced items.

The present invention describes a pedal-powered water propulsion device 10 that has a shape somewhat similar to a unicycle. The pedal-powered water propulsion device 10 implements a unique system for propelling a seated user through the water. The pedal-powered water propulsion device 10 enables that seated user to propel themselves across various bodies of water such as, but not limited to: ponds, lakes, oceans, and the like. The pedal-powered water propulsion device 10 includes a seat assembly 20 and pedals 64*a* and 64*b* which enable the seated user to manually turn a propeller 100. In practice, the pedal-powered water propulsion device 10 and at least some, possibly all, of a seated user's torso will be submerged.

Refer now to FIGS. 1 and 2 respectively for side perspective and sectional views of the pedal-powered water propulsion device 10. The pedal-powered water propulsion device 10 includes the seat assembly 20, an outer support tube 40, an inner support tube 46, an enclosed protective crank housing 60, a crank 62, a first foot pedal 64*a*, a second foot pedal 64*b*, an angularly adjustable first drive shaft tube 80*a*, a first drive shaft 81*a*, a universal joint 86, a second drive shaft tube 80*b*, a second drive shaft 81*b*, a tightening device 82, and a propeller 100.

Referring now primarily to FIGS. 1 and 3, a housing slot 90 and a locking device 92 enable the drive shaft tubes 80*a* and 80*b* as well as the propeller 100 and a propeller guard 102 to be set a various angles of propulsion relative to the seated user while that seated user is either on or diving below the surface of the water.

The seat assembly 20 provides hard or semi-rigid plastic sections that are preferably integrally molded together. Alternatively, the various seat assembly 20 sections can otherwise be assembled together. As shown in the various figures the seat assembly 20 includes a seat 22, a pelvic harness 24, and a pair of waist straps 28*a*, 28*b*.

The pelvic harness 24 includes a plurality of bow-shaped members, each having a first end affixed to a perimeter edge of the seat 22 and each extending upwardly therefrom. The bow-shaped members of the pelvis harness 24 are spaced apart to allow for the insertion of a user's legs therethrough and to provide for a comfortable seated position. The opposing second end of each of the bow-shaped members is affixed to an upper frame member 26. It is preferred that the pelvic harness 24 has an opening at the front end to allow ingress and egress of a user. The upper frame member 26 is preferred to reside in a horizontal plane and adapted to be located midway between a waist and an armpit of an average sized adult human.

The upper frame member 26 is configured to partially enclose a user's waist in a horizontal plane. The upper frame member 26 is joined to the terminating ends of the pelvic harness 24. While the illustrated embodiment of the device 10 shows opposing ends of the upper frame member 26 joined by a first waist strap 28*a* and second waist strap 28*b* it should be understood that other methods of closing may be utilized with equal benefit. Beneficially, the first waist strap 28*a* and the second waist strap 28*b* are made of flexible nylon or another flexible fabric and have respective latching side-release-type first buckle 30*a* and second buckle 30*b*. The waist straps 28*a*, 28*b* and buckles 30*a*, 30*b* are preferably length-adjusting so as to allow the pedal-powered water propulsion device 10 to conform to various sizes of seated users.

The seat assembly 20 is vertically adjustable to fit different sized seated users. Vertical adjustment is provided by an outer support tube 40 that slidingly receives with an inner support tube 46. The outer support tube 40 extends downward from the bottom of the seat 22 and is preferably integrally molded thereto. Alternatively, another method of attachment may be used. The outer support tube 40 includes a plurality of seat adjusting apertures 42 that are arranged in a row along a side of the outer support tube 40. The inner support tube 44 includes a correspondingly positioned spring button 44. When the desired height of the seat assembly 20 with respect to the foot pedals 64*a*, 64*b* is determined it can be fixed by engaging the spring button (or a friction clamping or a similar device) 44 into a desired seat adjusting aperture 42.

By comparing FIGS. 1, 2, and 3 it can be seen that the housing slot 90 and locking device 92 enable the seat assembly 20 to change angles relative to elements 80*a*, 80*b*, 82, 84, 100 and 102 to allow a seated user to obtain various angles of propulsion when either on or below the water surface.

The inner support tube 46 is beneficially rigidly affixed to a subjacent enclosed protective crank housing 60. The enclosed protective crank housing 60 is similar to the crank housing of a bicycle which enables a crank to apply rotational forces the foot pedals. In this case the enclosed protective crank housing 60 enables a seated user to apply rotational force to a "Z"-shaped crank 62 that connect to the foot pedals 64*a* and 64*b*. The enclosed protective crank housing 60 is a cylinder-shaped enclosure that supports and protects a centrally located first bevel gear 68*a*. The first bevel gear 68*a* is rigidly affixed at an intermediate position to the crank 62. The crank 62 extends from the enclosed protective crank housing 60 to the foot pedals 64*a*, 64*b*. The foot pedals 64*a*, 64*b* are rotatingly mounted to the ends of the crank 62 as in a conventional bicycle. Beneficially, each foot pedal 64*a* and 64*b* includes a hydrodynamic-shaped toe clip 66 to aid in retaining the user's feet upon the foot pedals 64*a*, 64*b* during use, as well as a heel strap 67 to retain a heel of a user therein. By hydrodynamic it is meant that the toe clips 66 are streamlined to move smoothly through the water.

The transmission of rotary forces applied to the crank 62 and to the first bevel gear 68*a* are used to rotate the propeller 100 via a mechanical drive train that includes the second bevel gear 68*b*. The second bevel gear 68*b* engages with the first bevel gear 68*a*. The second bevel gear 68*b* is integral to, or otherwise affixed to, the proximal end of the first drive shaft 81*a*. The first drive shaft 81*a* is contained and guided within the first drive shaft tube 80*a*. The first drive shaft tube 80*a* is angularly and adjustably affixed to the crank housing 60 via an adjusting bracket 94. The relative angle between the crank housing 60 and the first drive shaft tube 80*a* may be selected and secured by a seated user to enable that user to be propelled in a desired direction and at a desired attitude in the water (best seen in FIG. 3).

The rotational forces of the first drive shaft 81*a* are transmitted to the propeller 100 via the second drive shaft 81*b* which is coupled to the first drive shaft 81*a* in an orbitally-adjustable manner via the universal joint 86. The pedal-powered water propulsion device 10 enables angularly adjusting the first 81*a* and second 81*b* drive shafts relative to each other via the universal joint 86. This also enable pivoting the first drive shaft tube 80*a* and second drive shaft tube 80*b*.

The first drive shaft tube 80*a* and the second drive shaft tube 80*b* are pivoted together by a tightening device 82 that includes an axle 83 and a knob 84. The tightening device 82 allows the second drive shaft 81*b* and the propeller 100 to move along a vertical plane relative to the seated user (see arrows in FIGS. 1 and 3). Angular adjustment of the propeller 100 is accomplished by adjusting the relative angle between the first drive shaft tube 80*a* and the second drive shaft tube 80*b*. The first drive shaft tube 80*a* and the second drive shaft tube 80*b* are axially attached via the tightening device 82 and its axle 83 and knob 84. The tightening device 82 is affixed to opposing walls of the first 80*a* and second 80*b* drive shaft tubes. The tightening device 82 is envisioned as being similar to a conventional toothed or friction-type bicycle seat mount and is locked to secure the angle of the propeller 100 by using the knob 84.

The distal end of the second drive shaft tube 80*b* is envisioned to include an integrally-molded hemispherical propeller guard 102 having an open bottom. The propeller guard 102 protectively surrounds the propeller 100 using an open mesh construction that allows water flow. The propeller guard 102 protects the propeller 100 from damage or clogging by debris in the water.

It is envisioned that various models of the pedal-powered water propulsion device 10 would be made available with various sized propellers 100 and propeller guard 102. Such would enable proper fit for children and adults. It is also envisioned that the pedal-powered water propulsion device 10 may be sold in various attractive colors and patterns based upon a user's preference.

Referring now to FIG. 3, the crank housing 60 positions the first drive shaft tube 80*a* via the housing slot 90 formed or machined along the forward and rearward facing curved surfaces of the crank housing 60. The housing slot 90 slidingly receives an adjusting bracket 94 of the first drive shaft tube 80*a*, thereby allowing the adjusting bracket 94 to slide within the housing slot 90 to enable the affixed first drive shaft tube 80*a* to extend from the crank housing 60 at varying angles. The angular position of the first drive shaft tube 80*a* is secured via engagement of a lock bolt 96 with one (1) of a plurality of equally-spaced housing apertures 92 that are drilled or molded into the crank housing 60. The housing apertures 92 are arranged parallel to the adjacent housing slot 90. The corresponding lock bolt 96 is envisioned to threadingly engage a correspondingly positioned housing aperture 92 to secure the relative positions of the crank housing 60 and first drive shaft tube 80*a*.

The housing slot 90 extends around the front, bottom, and rear curved surfaces of the crank housing 60. This allows the first drive shaft tube 80*a* and the propeller 100 to be selectively positioned as desired. It is envisioned that the first drive shaft tube 80*a* may be secured at positions such as, but not limited to, directly rearward (parallel to the water surface), angled rearwardly downward, straight down, angled forwardly downward, directly forward, and the like. Furthermore, it is envisioned that a seated user may rotate the foot pedals 64*a*, 64*b* in a reverse direction if desired. It is further envisioned that the pedal-powered water propulsion device 10 may be designed to enable easy installation of various alternate first drive shaft tubes 80*a* having various lengths, different diameter propellers 100 and the like to the housing 60 to fit user preferences. It is also envisioned that the pedal-powered water propulsion device 10 may be designed to enable folding of the first drive shaft tube 80*a* toward the seat assembly 20 for convenient storage.

Additional positioning of the propeller 100 is accomplished by adjusting an angle between the first drive shaft tube 80*a* and second drive shaft tube 80*b* using the tightening device 82 as previously described in FIG. 2.

Finally, it should be understood that adjusting and securing the propeller 100 height and angle relative to the seat 22 and with other parts of the pedal-powered water propulsion device 10 and its foot attachments 66*a* and 66*b* are not limited to the particular embodiment illustrated herein. Other ways may be used to accomplished the same things. Furthermore, it is envisioned that other styles and configurations of the present invention can be easily incorporated into the teachings of the present invention, and while only one (1) particular configuration is shown and described that is for purposes of clarity and disclosure and not by way of limitation of scope.

In an alternate configuration of the seat assembly 20, a plurality of fasteners 25 can be affixed to interior surfaces of the upper frame member 26, capable of enabling a removable fastening of a user-supplied shoulder harness for additional restraint and safety. Such a plurality of fasteners 25 is beneficial for supporting a user having mobility issues, like the elderly, handicapped, or other similar situations.

The preferred embodiment of the present invention can be utilized by the common user in a simple and effortless manner with little or no training. After initial purchase or acquisition of the pedal-powered water propulsion device 10, it would be installed as indicated in FIGS. 1 and 3. The method of installing and utilizing the pedal-powered water propulsion device 10 may be achieved by: procuring a model of the pedal-powered water propulsion device 10 having a desired size and appearance; adjusting the spring button 44 to adjust the seat height; removing the lock bolt 96; adjusting the relative angle between the enclosed protective crank housing 60 and the first drive shaft tube 80*a* by moving the adjusting bracket 94 within the housing slot 90 until the desired angle is obtained; securing the angle of the first drive shaft tube 80*a* to the enclosed protective crank housing 60 by installing, threadingly engaging, and tightening the lock bolt 96 into a correspondingly positioned housing aperture 92; adjusting the angle of the propeller 100 by loosening the tightening device 82 using the knob 84; moving the second drive shaft tube 80*b* until obtaining a desired angle between the first drive shaft tube 80*a* and second drive shaft tube 80*b*; securing the angle of the drive shaft tubes 80*a*, 80*b* by tightening the knob 84; carrying the pedal-powered water propulsion device 10 into a body of water until the user is approximately chest deep in the water; inserting the user's legs through the openings in the pelvic harness 24; attaching the waist straps 28*a*, 28*b* by engaging the buckles 30*a*, 30*b*; adjusting the waist straps 28*a*, 28*b* until obtaining a comfortable fit; leaning forward or rearward as needed to stabilize the pedal-powered water propulsion device 10; inserting the user's feet into the toe clips 66 of the foot pedals 64*a*, 64*b* and heels into the heel straps 67; rotating the propeller 100 by rotating the pedals 64*a*, 64*b*; obtaining the desired direction of travel and angle of pitch by leaning and using one's arms and hands in a similar manner as swimming; and, benefiting from a propulsion-type water activity within a body of water afforded a user of the present invention 10.

It is envisioned that a user would utilize or attach various weights and buoyancy devices readily available on the open market to help adjust the proper height of the pedal-powered water propulsion device 10 and user in the water during use.

The pedal-powered water propulsion device 10 can be used on the surface of the water with the user's head being out of the water or the pedal-powered water propulsion device 10 may be utilized with a user being completely submerged while using scuba or similar gear. When using the pedal-powered water propulsion device 10 when completely submerged propulsion may be enhanced by alternating between forward and rearward pedaling of the pedal-powered water propulsion device 10.

While specifically envisioned as a recreational device to move a single person through the water, the pedal-powered water propulsion device 10 can also serve a useful purpose for military or rescue operations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A pedal-powered water propulsion vehicle, comprising:

a seat assembly having a seat attached to an adjustable seat frame and a pelvic harness attached at a first end to said seat and to an upper frame member at a second end, said pelvic harness having an opening providing access to said seat;

an enclosed crank housing attached to said seat frame;

a drive system within said crank housing, said drive system including a first driven gear coupled to a second driven gear;

a pedal operated crank for applying rotational force to said first driven gear and to said second driven gear;

a drive shaft assembly, comprising:

a first drive shaft turned by said second driven gear, said first drive shaft located within a first drive shaft housing that extends from said crank housing;

a second drive shaft having a first end mechanically coupled to said first drive shaft using an angularly adjustable universal joint, said second drive shaft located within a second drive shaft housing that extends from said first drive shaft housing at a second drive shaft adjustable angle; and, a propeller turned by said drive shaft assembly;

wherein said propeller is capable of moving a user on said seat through water.

2. The pedal-powered water propulsion vehicle of claim 1, wherein said seat frame includes an outer support tube attached to said seat and an inner support tube engaged within said outer support tube and attached to said crank housing.

3. The pedal-powered water propulsion vehicle of claim 2, wherein said outer support tube is selectively vertically adjustable relative to said inner support tube.

4. The pedal-powered water propulsion vehicle of claim 3, further including a locking mechanism for locking said outer support tube relative to said inner support tube.

5. The pedal-powered water propulsion vehicle of claim 1, further including a first pedal and a second pedal attached to said crank.

6. The pedal-powered water propulsion vehicle of claim 1, wherein said first drive shaft housing extends from said crank housing at a first drive shaft adjustable angle.

7. The pedal-powered water propulsion vehicle of claim 6, wherein said first adjustable angle can be locked.

8. The pedal-powered water propulsion vehicle of claim 1, wherein said second adjustable angle can be locked.

9. The pedal-powered water propulsion vehicle of claim 1, further including a propeller guard attached to said second drive shaft housing.

10. The pedal-powered water propulsion vehicle of claim 9, wherein said propeller guard encompasses said propeller.

11. The pedal-powered water propulsion vehicle of claim 1, wherein said first driven gear is a bevel gear and said second driven gear is a second bevel gear.

12. The pedal-powered water propulsion vehicle of claim 1, wherein said upper frame member includes a pair of removably attachable straps located adjacent to said opening.

13. The water propulsion vehicle of claim 12, further comprising a plurality of fasteners affixed to inner surfaces of said upper frame member.

14. The water propulsion vehicle of claim 1, further including a foot pedal having a hydrodynamic-shaped toe clip attached to said first pedal and said second pedal.

15. The water propulsion vehicle of claim 14, wherein said foot pedal further comprises a heel strap attached to said first pedal and said second pedal.

* * * * *